US006562206B2

(12) United States Patent
Showcatally

(10) Patent No.: US 6,562,206 B2
(45) Date of Patent: May 13, 2003

(54) ANODE ASSEMBLY

(75) Inventor: Shawn Showcatally, Mankato, MN (US)

(73) Assignee: Johnson Outdoors Inc., Racine, WI (US)

( * ) Notice: Subject to any disclaimer, the term of this patent is extended or adjusted under 35 U.S.C. 154(b) by 60 days.

(21) Appl. No.: 09/871,103

(22) Filed: May 31, 2001

(65) Prior Publication Data

US 2002/0179429 A1 Dec. 5, 2002

(51) Int. Cl.[7] ..... C25B 11/00

(52) U.S. Cl. ..... 204/280; 204/292; 204/293; 204/196.23; 204/196.24; 204/196.25; 204/196.3; 204/196.31; 204/196.37; 205/732; 205/733; 205/730; 205/735; 205/740; 440/12.65; 440/48; 440/49; 440/59; 440/64; 440/79; 440/81; 440/83; 411/81; 411/340; 411/349; 411/373; 411/900; 411/901; 416/245 A; 416/244 B

(58) Field of Search ..... 440/12.65, 48, 440/49, 59, 64, 79, 81, 83; 411/81, 340, 349, 373, 900, 901; 416/245 A, 244 B; 204/196.23, 196.25, 196.24, 196.37, 196.1, 196.3, 196.31, 292, 293, 280; 205/732, 733, 730, 740, 735

(56) References Cited

U.S. PATENT DOCUMENTS

| | | | | |
|---|---|---|---|---|
| 2,916,429 A | | 12/1959 | Vossnack et al. | 204/196 |
| 3,049,479 A | | 8/1962 | Preiser et al. | 204/147 |
| 3,330,751 A | | 7/1967 | Warner | 204/196 |
| 3,830,719 A | | 8/1974 | Cavil | 204/196 |
| 4,146,448 A | | 3/1979 | Nakano et al. | 204/148 |
| 4,391,567 A | * | 7/1983 | Ciampolillo | 204/196.25 |
| 4,486,181 A | | 12/1984 | Cavil | 440/49 |
| 4,492,877 A | | 1/1985 | Staerzl | 307/95 |
| 4,549,949 A | | 10/1985 | Guinn | 204/197 |
| 4,559,017 A | | 12/1985 | Cavil et al. | 440/76 |

OTHER PUBLICATIONS

Products known to be commercially available from Martyr Anodes. Website page (http://www.martyranodes.com) (2 pages), no month/year available.

Photographs of product understood to be available from Martyr Anodes (2 Pages), no month/year available.

Photograph of product understood to be available from Martyr Anodes (1 page), no month/year available.

Product known to be commercially available from West Marine of Watsonville, CA. Website page (http://www.west-marine.com/webapp/commerce/command/productl..) titled "Canada Lower Unit Anodes" (3 sheets), no month/year available.

* cited by examiner

*Primary Examiner*—Bruce F. Bell
(74) *Attorney, Agent, or Firm*—Foley & Lardner

(57) ABSTRACT

A propeller attachment is disclosed including a body, the body including an anodic material, at least one projection projecting from the body, and a fastener coupled to the body. An anode is also disclosed including an annular body constructed from an anodic material, a fastener disposed centrally in the annular body, and at least one extension coupled to the annular body, the at least one extension is configured to allow for gripping of the anode. A fastener for coupling a propeller to a drive shaft of a lower unit is disclosed including a fastening portion configured to threadably engage the drive shaft and retain the propeller. The fastener further includes an anodic portion disposed around the fastening portion. The anodic portion is shaped to form at least one grip, and the anodic portion preferentially corrodes to prevent corrosion of the lower unit.

38 Claims, 5 Drawing Sheets

ANODE ASSEMBLY

FIELD OF THE INVENTION

The present invention relates generally to the field of anodes. Specifically, the present invention relates to the field of anodes for use on submersible motors, propellers and the like.

BACKGROUND OF THE INVENTION

Certain materials (typically metals, and metal alloys) corrode (i.e. rust, pit, deteriorate, etc.) due to various corrosive phenomena. Such corrosive phenomena may include electrochemical corrosion such as galvanic corrosion. Galvanic corrosion occurs when dissimilar materials are in contact with each other, and an electrical circuit is completed. Often, electrolytic solutions complete the electrical connection which causes galvanic corrosion. Electrolytic solutions, which provide mobile charge carriers for the conduction of electrical current, are often provided by water, such as salt water, pond water, or other such solutions.

When dissimilar metals are in contact with each other in a "galvanic series," the more anodic material (i.e. the material with a higher tendency to sacrifice electrons in a galvanic series) will preferentially sacrifice electrons for the less anodic (or more cathodic) material. The electrons which are sacrificed for the cathodic material result in the corrosion or deterioration of the anodic material. Higher carrier mobility in the electrolytic solution may result in an enhanced or accelerated corrosion rate of the anodic material. Anodic materials may corrode at an enhanced or accelerated rate when submerged in electrolytic solutions such as water, including salt water, fresh water, etc.

It is know to provide an additional sacrificial anode, with higher anodic characteristics than the dissimilar materials which are to be protected, in electrical communication with the dissimilar materials, in order to inhibit or slow the rate of corrosion of the dissimilar materials. However, such sacrificial anodes are not well suited for use on submersible motors, propellers, lower units, and the like. Submersible motors, propellers, and lower units are often constructed from dissimilar materials, and submersed in an electrolytic solution such as pond water, lake water, salt water, etc. Due to this combination, the motors, propellers, and lower units may have an enhanced or accelerated rate of corrosion. Such arrangements often require the use of sacrificial anodes to slow or prevent corrosion.

However, typical sacrificial anodes often require multiple assembly steps to install the anode in the desired location. Furthermore, typical sacrificial anodes are not integral to the motor, propeller or lower unit, and may be difficult to install. Also, installing sacrificial anodes often requires compromising the body with invasive procedures such as drilling, tapping, etc.

Accordingly, it would be advantageous to provide an anode which would be integral to the design of the motor, propeller, or lower unit. It would also be advantageous to provide an anode with a design which minimizes the number of parts required, and reduces the cost of construction. Also, it would be advantageous to provide an anode which could be provided on a motor, propeller, or lower unit without additional assembly steps. It would further be advantageous to provide an anode which is easy to remove and replace. Furthermore, it would be advantageous to provide an anode which may be mounted without compromising the unit or body. It would also be advantageous to provide an anode which offers an integral construction.

It would be desirable to provide a propeller assembly which provides one or more of these advantageous features. The techniques below extend to those embodiments which fall within the scope of the appended claims, regardless of whether they provide one or more of the above-mentioned advantageous features.

SUMMARY OF THE INVENTION

According to one exemplary embodiment, a propeller attachment includes a body, the body including an anodic material, at least one projection projecting from the body, and a fastener coupled to the body.

According to another exemplary embodiment, an anode includes an annular body constructed from an anodic material, a fastener disposed centrally in the annular body, and at least one extension coupled to the annular body, the at least one extension is configured to allow for gripping of the anode.

According to another exemplary embodiment, a fastener for coupling a propeller to a drive shaft of a lower unit includes a fastening portion configured to threadably engage the drive shaft and retain the propeller. The fastener further includes an anodic portion disposed around the fastening portion. The anodic portion is shaped to form at least one grip, and the anodic portion preferentially corrodes to prevent corrosion of the lower unit.

DETAILED DESCRIPTION OF THE PREFERRED EMBODIMENTS

Figure 1:
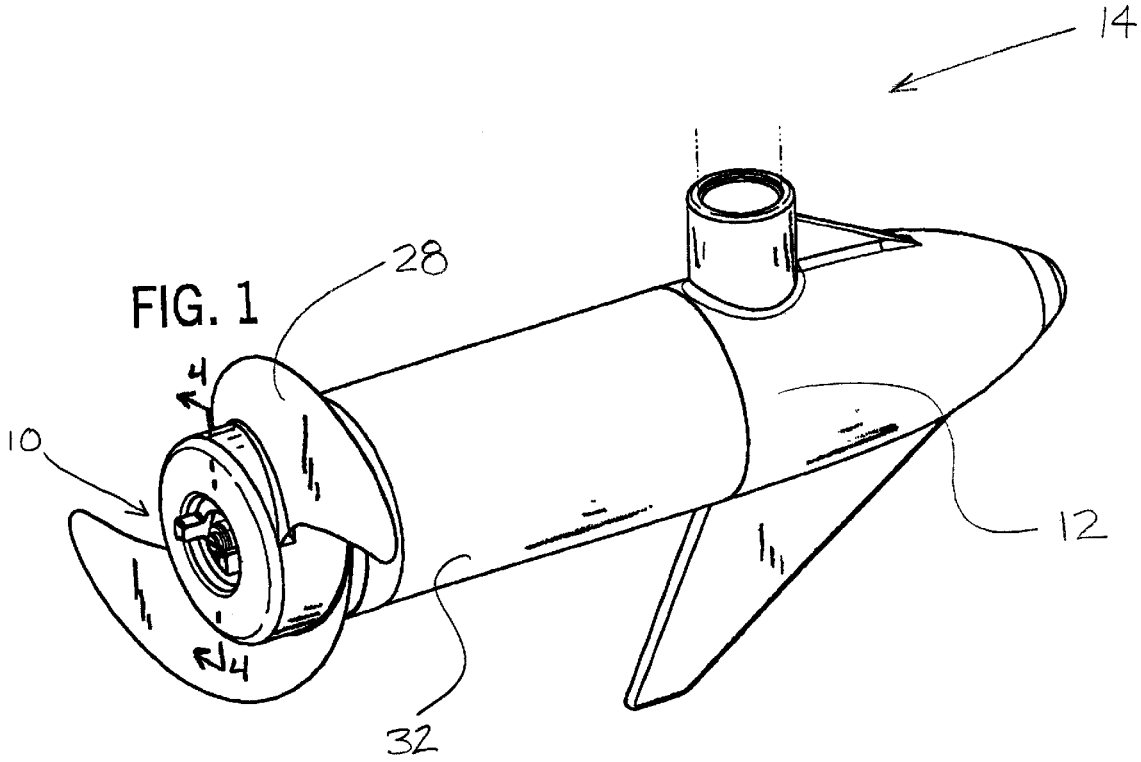
FIG. 1 is a perspective view of an anode assembly according to an exemplary embodiment.

Referring to FIG. 1, an anode assembly 10 is shown on a lower unit 12 of a trolling motor 14. It should be noted at the outset that anode assembly 10 may be used on a variety of structures and assemblies which require anodic protection. For example, anode assembly 10 may be used on various submersible propellers such as outboard motor propellers, submersible pumps, shaft driven devices which may be subjected to corrosive effects, etc.

Figure 2:
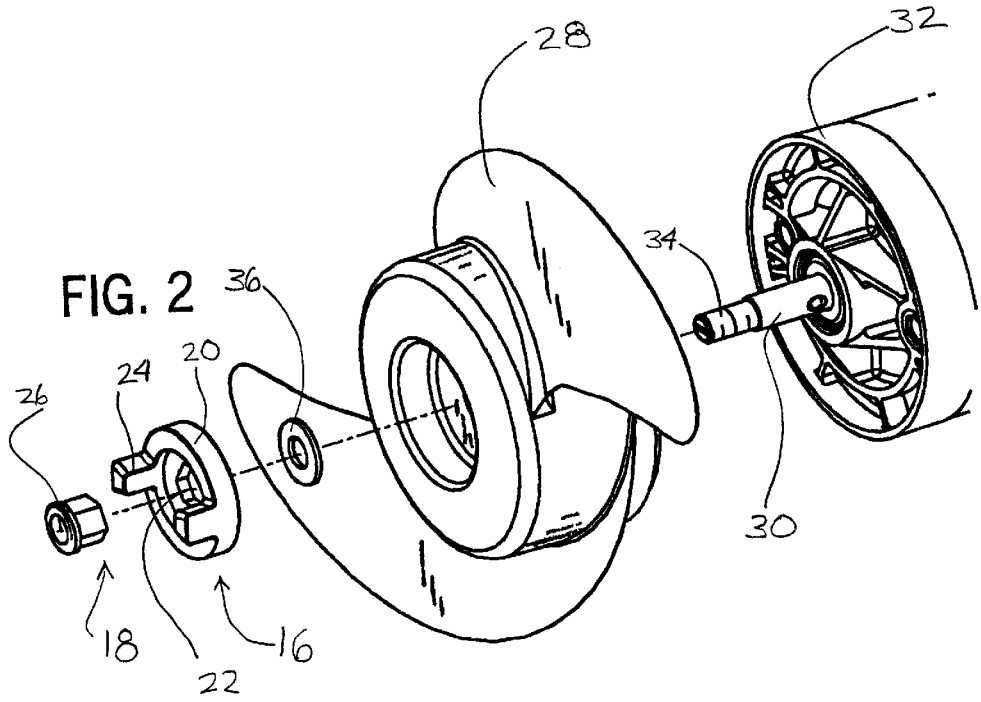
FIG. 2 is an exploded perspective view of the anode assembly.
Figure 3:
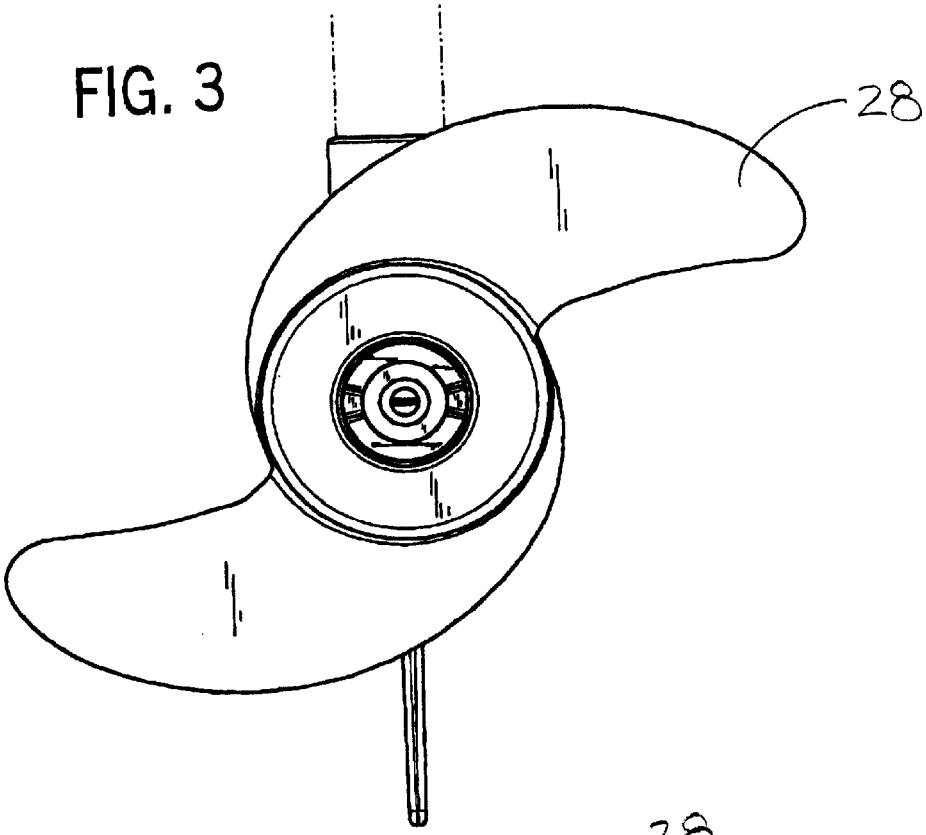
FIG. 3 is a side elevation view of the anode assembly.
Figure 4:
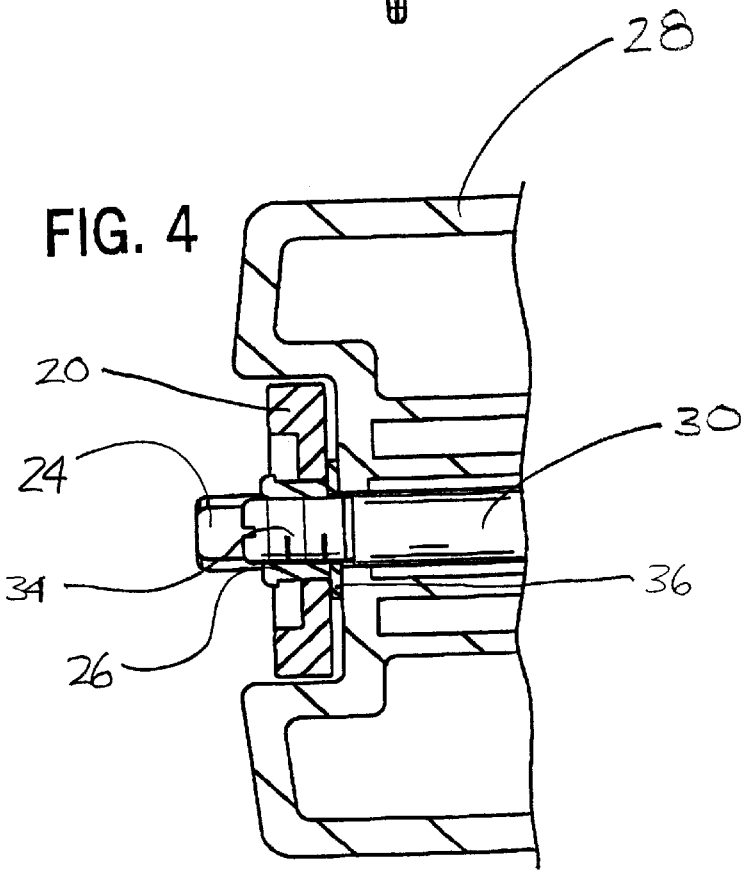
FIG. 4 is a cross-section view of the anode assembly shown in FIG. 1, taken along the line 4—4.
Figure 7:
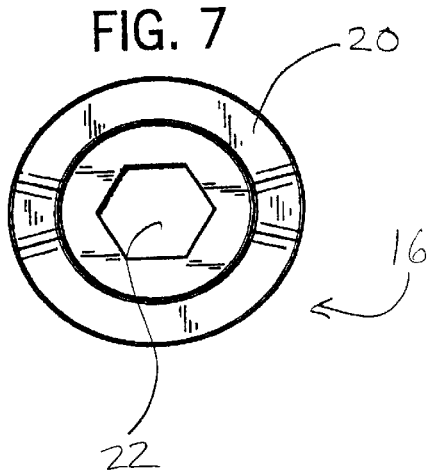
FIG. 7 is a front elevation view of the anode portion shown in FIG. 5.

As shown in FIG. 2, anode assembly 10 includes anode portion 16 and fastening portion 18. In an exemplary embodiment, anode portion 16 includes body 20, aperture 22 and projections 24. As shown in FIG. 7, body 20 may have an annular or ring shape. Body 20 is generally constructed from a suitable anodic material. In an exemplary embodiment, body 20 includes lead, iron, cadmium, copper, aluminum, and zinc. In a particularly preferred embodiment, body 20 is constructed from 0.006% lead, 0.005% iron, 0.025–0.070% cadmium, 0.005% copper, 0.1–0.5% aluminum, and the remainder of zinc. According to another particularly preferred embodiment, body 20 is constructed from at most 0.006% lead, at most 0.005% iron, at most 0.025–0.070% cadmium, at (most 0.005% copper, at most 0.1–0.5% aluminum, and the remainder of zinc. Alternatively, body 20 may further include, or be constructed from magnesium, lithium, titanium, manganese, chromium, nickel, tin, and/or other suitable anodic materials.

Figure 6:
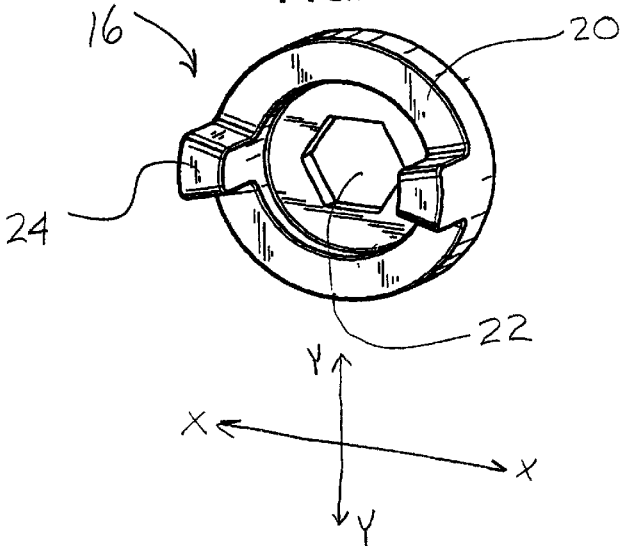
FIG. 6 is a perspective view of the anode portion shown in FIG. 5.

As shown in FIG. 6, aperture 22 is provided in the center of body 20. Aperture 22 generally has a shape corresponding to a fastening portion 18, as will be discussed in further detail below. Alternatively, the body may have other shapes and geometries, and the aperture may be provided in different locations as to allow the proper functioning of, mounting, and attachment of the anode assembly.

Figure 8:
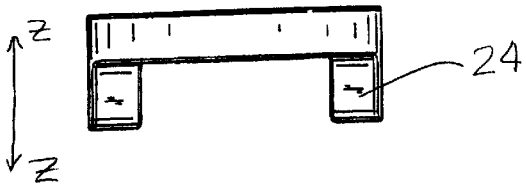
FIG. 8 is a top plan view of the anode portion shown in FIG. 5.
Figure 9:
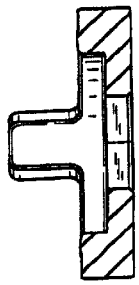
FIG. 9 is a cross-section view of the anode portion shown in FIG. 6, taken along the line 9—9.
Figure 10:
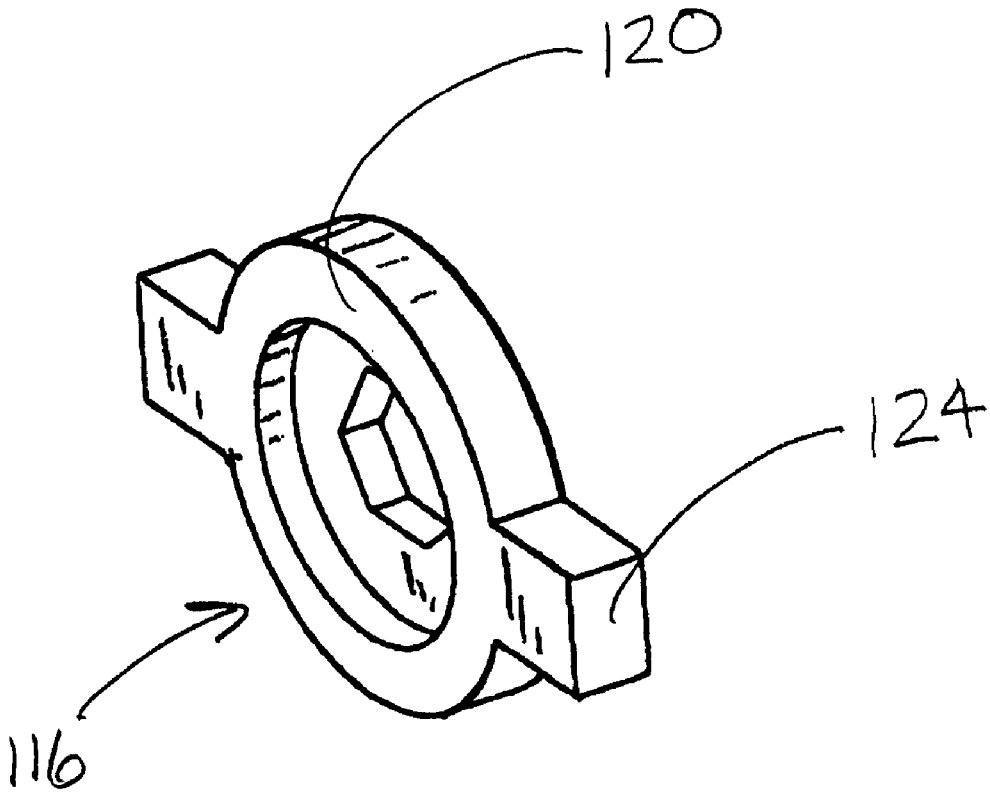
FIG. 10 is a perspective view of an anode portion according to an alternative embodiment.

Anode portion 16 further includes projections 24. Projections 24 are provided on, and extend from body 20. In an exemplary embodiment shown in FIG. 6, body 20 lies generally in a plane formed with horizontal axis X—X and vertical axis Y—Y. Projections 24 extend out of the plane formed generally by body 20. As shown in FIG. 8, projections 24 extend normal to body 20, along depth axis Z—Z. In an alternative embodiment shown in FIG. 10, anode portion 116 includes projections 124 which may be coplanar with body 120, extending radially therefrom. The projections may be tabs, ears, extensions, grips, or other similar type features which provide for grasping of the body (and corresponding anode assembly). The projections advantageously provide a feature or structure which allows the anode assembly to be easily installed or removed by hand, or with simple tools such as pliers, screw drivers, wrenches, etc.

Figure 5:
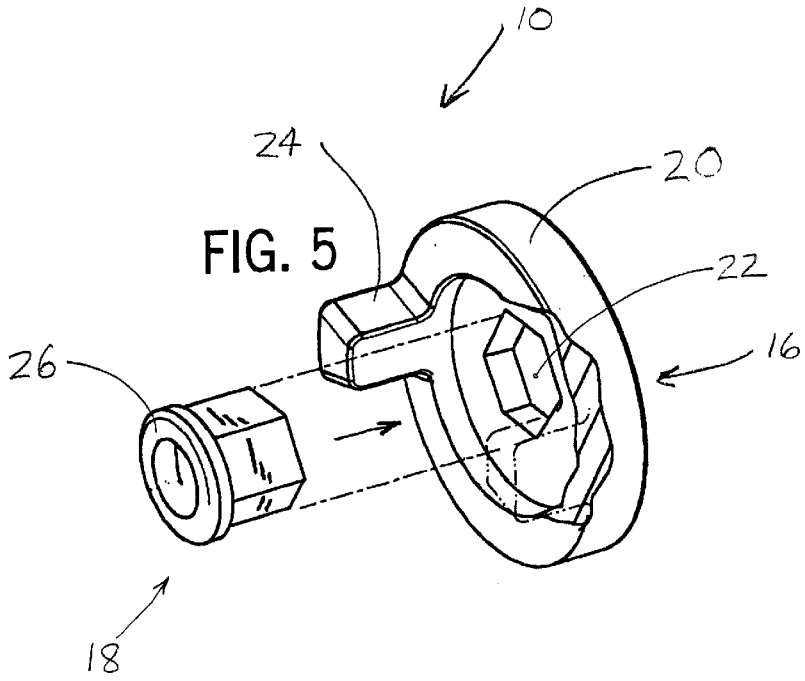
FIG. 5 is an exploded perspective view of an anode portion and a fastening portion according to an exemplary embodiment.
Figure 11:
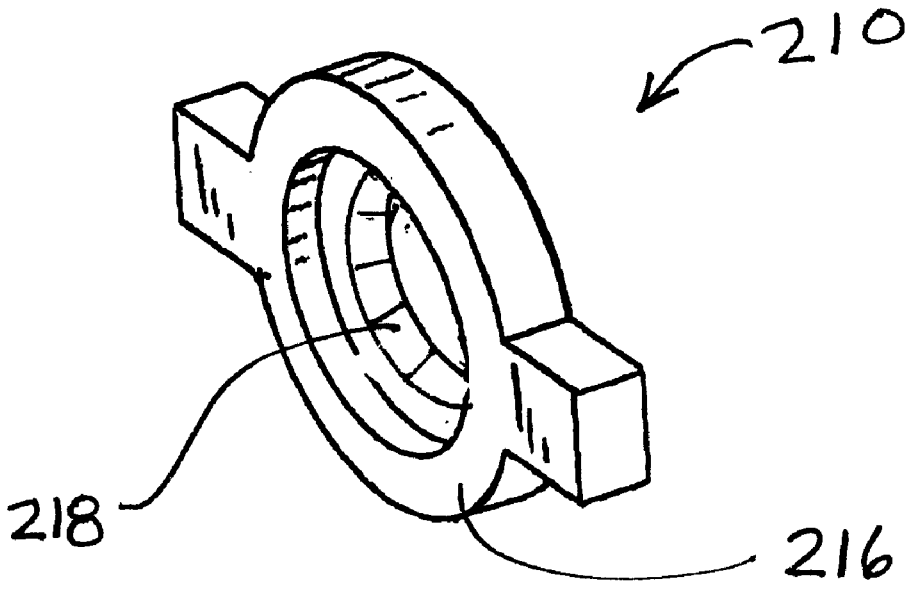
FIG. 11 is a perspective view of an anode assembly according to an alternative embodiment.
Figure 1:
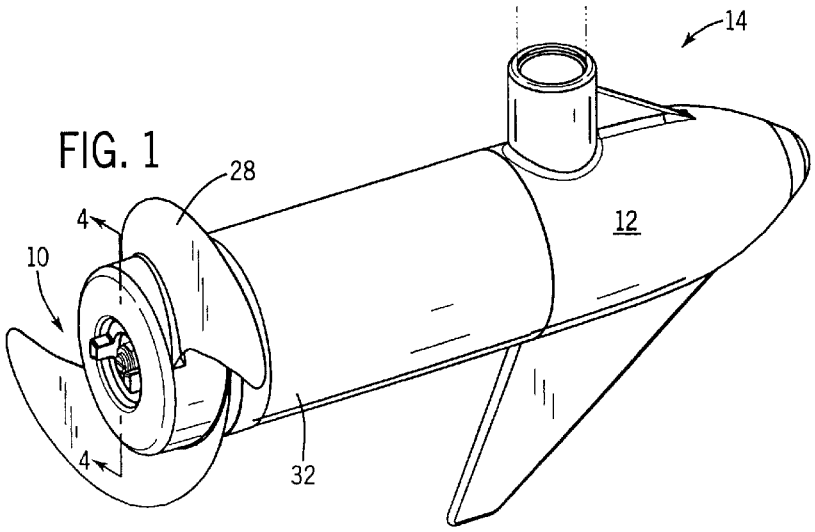
Figure 2:
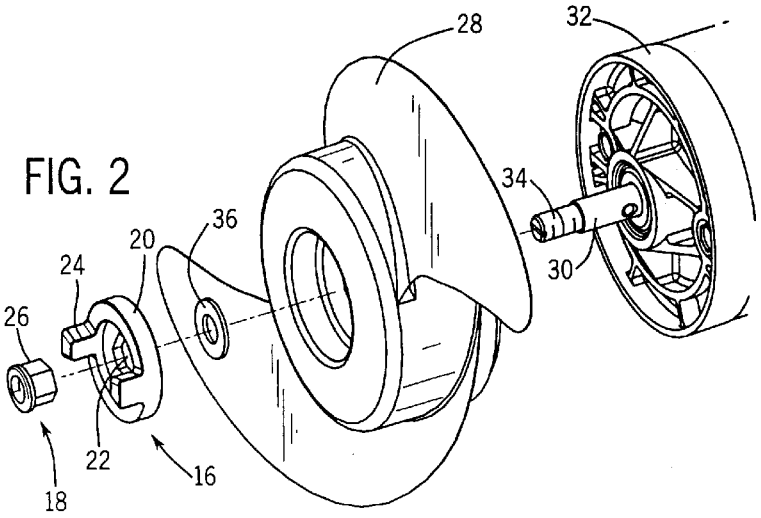
Figure 3:
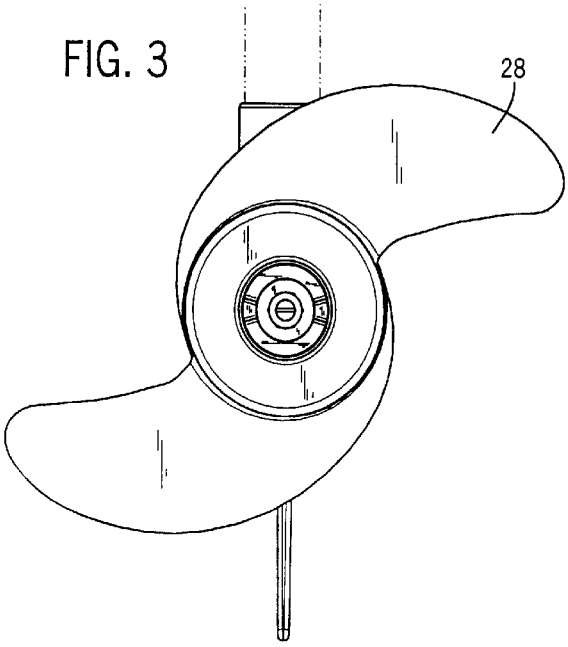
Figure 4:
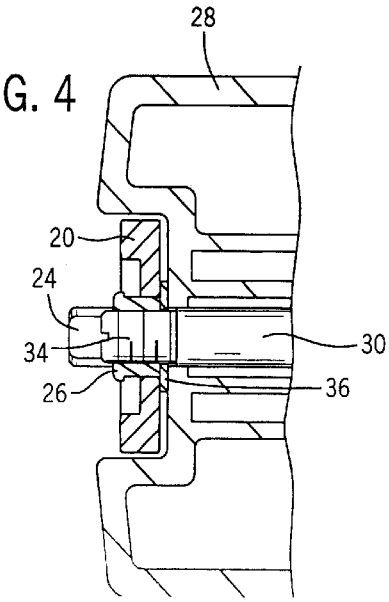
Figure 5:
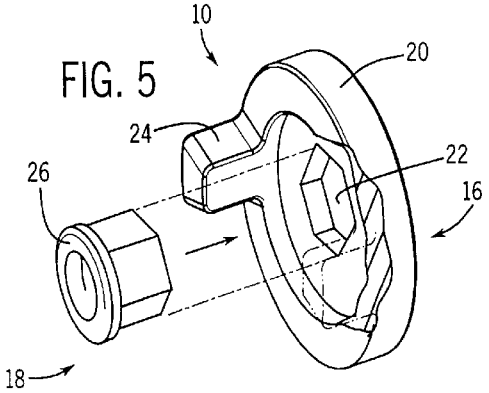
Figure 6:
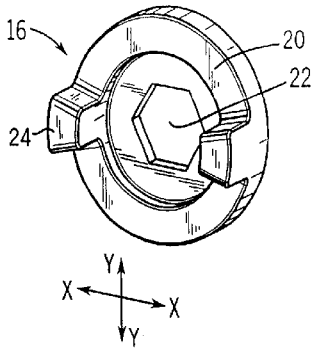
Figure 7:
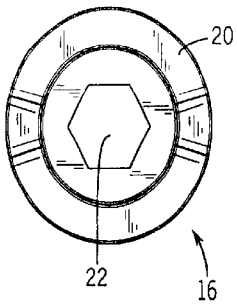
Figure 8:
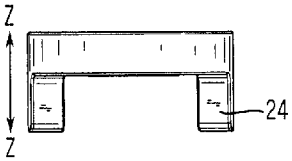
Figure 9:
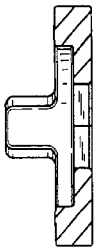
Figure 10:
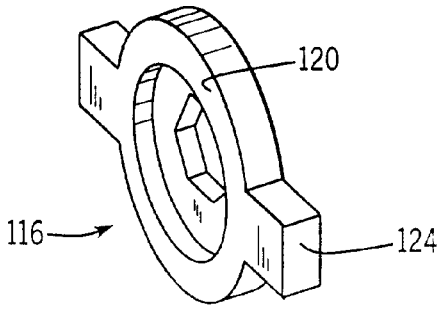
Figure 11:
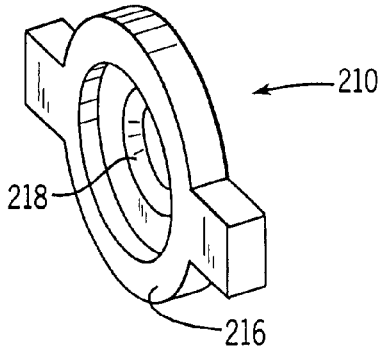

Referring to FIG. 5, fastening portion 18 is coupled to anode portion 16. In an exemplary embodiment, fastening portion 18 is a fastener shown as nut 26. In a preferred embodiment, nut 26 is a standard sized hexagonal fastening nut. Nut 26 may be coupled to body 20 by press-fitting nut 26 into aperture 22. Alternatively, the nut may be coupled to the body by a variety of fastening techniques including soldering, welding, adhesives, etc. In an alternative embodiment shown in FIG. 11, anode assembly 210 may be a unitary construction, with the anode portion 216 and the fastening portion 218 being constructed as a unitary piece by techniques such as co-molding or similar processes.

The functioning, operation, and installation of anode assembly 10 will be described below.

In an exemplary embodiment shown in FIG. 1, anode assembly 10 may be used on submersible motors, such as those used in boats and water craft including outboard motors, inboard motors, trolling motors, etc. Anode assembly 10 may be used to secure or fasten a propeller 28 to a drive shaft 30 on such a motor, shown as lower unit 12 of a trolling motor 14.

Shaft 30 may be provided with a fastener (shown as threaded portion 34) which is configured to engage a threaded portion 34 on nut 26. Propeller 28 is slid onto shaft 30 through an aperture (not shown) in the center of propeller 28. A spacer or retainer (shown as washer 36) may then be provided on shaft 30. Anode assembly 10 is then fastened on to threaded portion 34 of shaft 30. As anode assembly is tightened, nut 26 further engages threaded portion 34 of shaft 30, and bears down on washer 36 and firmly retains propeller 28 with respect to shaft 30.

Propeller 28 on lower unit 12 of trolling motor 14 may generally be constructed of plastic, and therefore will not be subjected to corrosive phenomena. However, several components in lower unit 12 are made of materials which may corrode. Such materials generally are metallic, such as steel, steel alloys, aluminum, aluminum alloys, or other such metals which may corrode.

Lower unit 12 will often be constructed from a variety of dissimilar materials for various design concerns. For example, a housing 32 of lower unit 12 may be constructed from an aluminum alloy for weight concerns, while drive shaft 30 and various other motor components may be constructed from steel for strength or other design concerns.

Contact between two dissimilar metals (such as aluminum and steel) in an electrolytic solution may create an electrochemical cell which may cause electrochemical corrosion. Metals in such an electrochemical cell will tend to be either anodic or cathodic, and create a "galvanic series." A galvanic series is a rating of the materials according to their anodic or cathodic tendencies. An anodic material will tend to give up electrons in the electrochemical cell and corrode, while a cathodic material will tend to receive electrons in the electrochemical cell, and not corrode.

Referring to FIG. 2, anode assembly 10 is shown attaching propeller 28 to shaft 30 of lower unit 12. Lower unit 12 of trolling motor 14 includes an outer shell or casing, shown as housing 32 surrounding shaft 30. Housing 32 may typically be constructed from an aluminum or aluminum alloy. Lower unit 12 of trolling motor 14 may further include an electric motor (not shown) contained within housing 32. The electric motor will power shaft 30 in rotation, and thus power the rotation of propeller 28 through water. The electric motor and shaft 30 may include steel or steel alloys.

Thus in lower unit 12, the contact of aluminum housing 32 and steel drive shaft 30 in an electrolytic solution (i.e. water, salt water, etc.) will create an electrochemical cell, and will promote the corrosion of the more anodic material (i.e. aluminum housing 32). In order to prevent the corrosion of the anodic material in the galvanic series, a sacrificial anode (i.e. anode assembly 10) may be provided. The anode material of anode assembly 10 will have an even higher anodic potential than aluminum housing 32, and thus will preferentially corrode instead of aluminum housing 32.

Anode assembly 10 provides several advantages for the anodic protection of lower unit 12. Anode assembly 10 provides a design which is integral to the design of lower unit 12, and used to retain propeller 28, not an additional part needed to be assembled onto lower unit 12. The integral design advantageously provides for lowered assembly costs by reducing the number of parts required to be assembled. The integral design also allows anode assembly 10 to be used on lower unit 12 without additional, possibly invasive, attachment steps such as drilling or tapping. Additionally, anode assembly 10 provides a design which is easy to remove and replace. Projections 24 on anode assembly 10 allow anode assembly 10 to be easily removed by hand, or with tools such as a screw drive, pliers, wrench, or other common tools. Additionally, projections 24 advantageously offer an additional volume of sacrificial anodic material, thus prolonging the expected life of anode assembly 10.

It is also important to note that the construction and arrangement of the elements of the anode assembly shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the preferred and other exemplary embodiments without departing from the scope of the present inventions as expressed in the appended claims.

What is claimed is:

1. A propeller attachment, comprising:

a body, the body including an anodic material;

at least one projection provided on the body and configured to facilitate removal and mounting of the attachment; and a fastener coupled to the body.

2. The propeller attachment of claim 1, wherein the fastener is a nut.

3. The propeller attachment of claim 2, wherein the nut is pressed into the body.

4. The propeller attachment of claim 3, wherein the body further includes an aperture configured to receive the nut.

5. The propeller attachment of claim 1, wherein the body and the fastener are co-molded.

6. The propeller attachment of claim 1, wherein the body lies substantially in a plane, and the at least one projection is substantially perpendicular to the plane.

7. The propeller attachment of claim 1, wherein the body lies substantially in a plane, and the at least one projection is substantially radial to the plane.

8. The propeller attachment of claim 1, wherein the at least one projection is a tab.

9. The propeller attachment of claim 1, wherein the anodic material includes zinc, magnesium, lead, iron, cadmium, copper, aluminum, lithium, titanium, manganese, chromium, nickel, or tin.

10. The propeller attachment of claim 9, wherein the anodic material includes at most 0.006% lead, at most 0.005% iron, at most 0.025–0.070% cadmium, at most 0.005% copper, at most 0.1–0.5% aluminum, and the remainder of zinc.

11. An anode comprising:

an annular body constructed from an anodic material;

a fastener disposed centrally in the annular body; and at least one extension coupled to the annular body, the at least one extension configured to allow for gripping of the anode.

12. The anode of claim 11, wherein the annular body lies substantially in a plane, and the at least one extension is substantially perpendicular to the plane of the annular body.

13. The anode of claim 11, wherein the annular body lies substantially in a plane, and the at least one extension is substantially coplanar with plane of the annular body.

14. The anode of claim 11, wherein the at least one extension includes at least one tab.

15. The anode of claim 11, wherein the fastener comprises a nut.

16. The anode of claim 15, wherein the annular body includes an aperture and wherein a nut is pressed into the aperture.

17. The anode of claim 11, wherein the anodic material includes zinc, magnesium, lead, iron, cadmium, copper, aluminum, lithium, titanium, manganese, chromium, nickel, or tin.

18. The anode of claim 17, wherein the anodic material includes at most 0.006% lead, at most 0.005% iron, at most 0.025–0.070% cadmium, at most 0.005% copper, at most 0.1–0.5% aluminum, and the remainder of zinc.

19. A fastener for coupling a propeller to a drive shaft of a lower unit, the fastener comprising:

a fastening portion configured to threadably engage the drive shaft and retain the propeller; and an anodic portion disposed around the fastening portion, wherein the anodic portion is shaped to form at least one grip and wherein the anodic portion preferentially corrodes as compared to the lower unit to prevent corrosion of the lower unit.

20. The fastener of claim 19, wherein the fastening portion further comprises a nut pressed into the anodic portion.

21. The fastener of claim 19, wherein the anodic portion and the fastening portion are co-molded.

22. The fastener of claim 19, wherein the fastening portion lies substantially in a plane, and the at least one grip is substantially perpendicular to the plane of the fastening portion.

23. The fastener of claim 19, wherein the fastening portion lies substantially in a plane, and the at least one grip extends coplanar with the plane of the fastening portion.

24. The fastener of claim 19, wherein the at least one grip is at least one tab.

25. The fastener of claim 19, wherein the anodic portion includes zinc, magnesium, lead, iron, cadmium, copper, aluminum, lithium, titanium, manganese, chromium, nickel, or tin.

26. The fastener of claim 25, wherein the anodic material includes at most 0.006% lead, at most 0.005% iron, at most 0.025–0.070% cadmium, at most 0.005% copper, at most 0.1–0.5% aluminum, and the remainder of zinc.

27. A fastener for coupling a propeller to a drive shaft of a lower unit, the fastener comprising:

a fastening portion configured to engage the drive shaft; and an anodic portion integrally formed with the fastening portion and wherein the anodic portion preferentially corrodes as compared to the lower unit to prevent corrosion of the lower unit.

28. The fastener of claim 27, further comprising at least one extension formed in the anodic portion and configured to allow for gripping of the fastener.

29. The fastener of claim 28, wherein the fastening portion lies substantially in a plane, and the at least one extension is substantially perpendicular to the plane of the fastening portion.

30. The fastener of claim 28, wherein the fastening portion lies substantially in a plane, and the at least one extension extends coplanar with the plane of the fastening portion.

31. The fastener of claim 27, wherein the at least one extension further comprises at least two projections.

32. The fastener of claim 27, wherein the anodic portion integrally formed with the fastening portion further comprises the anodic portion being coupled to the fastening portion.

33. The fastener of claim 27, wherein the anodic portion integrally formed with the fastening portion further comprises the anodic portion and the fastening portion being co-molded.

34. The fastener of claim 27, wherein the anodic portion integrally formed with the fastening portion further comprises the anodic portion and the fastening portion being press-fit together.

35. The fastener of claim 27, wherein the at least one extension is at least one tab.

36. The fastener of claim 27, wherein the at least one extension is at least one grip.

37. The fastener of claim 27, wherein the anodic portion includes at least one of zinc, magnesium, lead, iron, cadmium, copper, aluminum, lithium, titanium, manganese, chromium, nickel, and tin.

38. The fastener of claim 27, wherein the anodic material includes at most 0.006% lead, at most 0.005% iron, at most 0.025–0.070% cadmium, at mos. 0.005% copper, at most 0.1–0.5% aluminum, and the remainder of zinc.

* * * * *

UNITED STATES PATENT AND TRADEMARK OFFICE

CERTIFICATE OF CORRECTION

PATENT NO. : 6,562,206 B2
DATED : May 13, 2003
INVENTOR(S) : Shawn Showcatally

It is certified that error appears in the above-identified patent and that said Letters Patent is hereby corrected as shown below:

Please substitute the attached drawings.

Signed and Sealed this

Sixteenth Day of December, 2003

JAMES E. ROGAN
*Director of the United States Patent and Trademark Office*